US006237164B1

(12) United States Patent
LaFontaine et al.

(10) Patent No.: US 6,237,164 B1
(45) Date of Patent: May 29, 2001

(54) TOILET TANK ASSEMBLY

(76) Inventors: Joseph A. LaFontaine, P.O. 91, Salem, UT (US) 84653; Brent D. Barnett, 90 W. 4750 North; Daniel T. LaFontaine, 4620 Mile High Dr., both of Provo, UT (US) 84604

( * ) Notice: Subject to any disclaimer, the term of this patent is extended or adjusted under 35 U.S.C. 154(b) by 0 days.

(21) Appl. No.: 09/360,762

(22) Filed: Jul. 26, 1999

(51) Int. Cl.[7] ..... E03D 1/00

(52) U.S. Cl. ..... 4/353; 4/378; 4/395; 4/398

(58) Field of Search ..... 4/353, 378, 395, 4/397–399, 401, 227.1–227.4; 215/6; 220/553, 555, 507; 137/391, 397, 398, 410, 433; 251/324, 118

(56) References Cited

U.S. PATENT DOCUMENTS 3,860,972 * 1/1975 Costello ..... 4/378
4,196,482 * 4/1980 Martinez Mendez ..... 4/378
4,272,768 * 6/1981 Rookard, Jr. ..... 215/6
4,696,414 * 9/1987 Huat ..... 4/227.2
5,363,513 * 11/1994 Blankenburg ..... 4/353
5,651,471 * 7/1997 Green ..... 220/231

FOREIGN PATENT DOCUMENTS

532375 A1 * 3/1993 (EP) ..... 4/378

* cited by examiner

*Primary Examiner*—Gregory L. Huson
*Assistant Examiner*—Tuan Nguyen

(57) ABSTRACT

A toilet supply tank assembly having high performance flush characteristics is designed to maximize water pressure over the flush valve and to minimize fluid turbulence within the tank during a flush cycle. The tank includes a bottom interior surface which tapers downwardly from the outer edges thereof to an fluid escape opening, and may include a cylindrical tank having a frusto-conical bottom portion with the fluid escape opening at the most narrow portion thereof. In order to further reduce turbulence created by water flow within the tank during a flush cycle, a cylindrical flush valve plunger having a frusto-conical stopper portion is provided which has no abrupt transitions. The tank may also include at least three vertical partitions intersecting a common axis which not only provide a cage in which the flush valve plunger can slide up and down, but also prevent the water from swirling and forming an energy robbing vortex.

6 Claims, 6 Drawing Sheets

TOILET TANK ASSEMBLY

BACKGROUND OF THE INVENTION

1. Field of the Invention

This invention relates generally to toilets, and more specifically, to the design of tanks which are used to store a quantity of water used to flush effluent from the toilet bowl.

2. History of the Prior Art

In the Western world, the earliest plumbing systems were developed to dispose of human wastes. Nearly simultaneous development of sewage disposal systems occurred in several locations in the ancient world. The earthenware pipes, masonry sewers, and toilets installed in about 2,500 B.C. in Mesopotamian cities (now included in present day Iraq), are still in working order. In the Indus Valley in what is now Pakistan and western India, most dwellings had drains for waste disposal by about 2500 B.C. A palace built on the island of Crete about 2000 B.C. had primitive toilets and a drainage system with air shafts that served as vents. The Romans contributed to the development of modem plumbing systems by constructing distribution systems for potable water, using lead pipes and fixtures.

After the fall of the Roman Empire in 476 A.D., the quality of plumbing declined throughout the Western world. During the Middle Ages, people disposed of waste materials by throwing them into the street. Although a type of flush toilet was developed in the 1500's, it did not come into wide use because of the general lack of plumbing and sewer systems. During the $17^{th}$ century, many cities throughout the world began to construct water and sewer systems. In 1778, Joseph Bramah, an English cabinet maker, patented an improved flush toilet. By 1800, toilets had become common in England. But most of them drained into cesspools, which often overflowed. Septic tanks were invented in the mid-1800's, and a modem sewer system began operating in London in the 1860's.

For nearly two hundred years following the patenting of Joseph Bramah's improved flush toilet, though thousands of U.S. patents were granted for improvements to the device, the functional design of the fixture changed very little. Aesthetic improvements to the device were a major focus of inventors. Some of the efforts aimed at improving the aesthetics of the humble fixture actually degraded its performance rather dramatically. For instance, in the mid-1970's, a low profile toilet was manufactured that had rather abysmal flush performance as a result of the low potential energy of the water stored within the supply tank.

Several decades ago, water conservation suddenly became the rage. The standard tank-type toilet, which used about five gallons of water per flush cycle came under attack. In order to reduce water consumption, it became common to place bricks at the bottom of the supply tank Flush performance was somewhat decreased as a result. Then, in 1992, the U.S. Congress passed a national standard for new toilets, limiting them to 1.6 gallons (approximately 6.76 liters) per flush cycle. In some foreign countries, such as Singapore, where potable water is scarce, new toilets will be limited to only 4.5 liters per flush cycle.

The key to improving flush performance and decreasing water consumption is tank pressure. Europeans have long known that flush performance can be dramatically improved by elevating the toilet's supply tank to ceiling level. However, in the U.S. at least, that design is ignored because installation is more time consuming and the aesthetics of the device are apparently unacceptable. Many new water-efficient toilets available in the U.S. incorporate a supply tank that is pressurized by the water main. Such toilets provide acceptable flush performance using only about 1 and ½ gallons, or slightly less than 6 liters, of water. These toilets suffer from three major disadvantages. Firstly, they are considerably more expensive than a conventional toilet with an unpressurized supply tank. Secondly, in areas where water pressure is low or is variable over a wide range, flush performance will be unacceptable at least some of the time. Thirdly, the tank flush valve is more complex and not easily repaired by untrained service personnel.

Unpressurized toilets using 6.76 liters of water per flush are also available in the U.S. The problem with these devices is that flush performance is generally marginal. Consequently, many consumers tamper with the fill and flush mechanisms so that the water released per flush cycle is increased. Often the amount exceeds 13.0 liters per flush cycle. Another remedy for poor flush performance is double or triple flushing of the system. Many replacement components are available for these water-efficient toilets. However, there is no guarantee that a repaired toilet will conform to the original specifications. Another problem with water-efficient unpressurized toilets is the flapper component of the tank flush valve. Chlorine tends to deteriorate the rubber from which they are made, resulting in a device which may leak more water than it uses for operation.

What is needed is a toilet having low cost in combination with high performance flush characteristics, low water consumption, ease of maintenance, and a high degree of tamper resistance.

SUMMARY OF THE INVENTION

A toilet supply tank assembly having high performance flush characteristics is designed to maximize water pressure over the flush valve and to minimize fluid turbulence within the tank during a flush cycle. The greater the water pressure and the less dissipation of potential energy through turbulence, the less the water required for each flush cycle. The tank includes a bottom interior surface which tapers downwardly from the outer edges thereof to a fluid escape opening. This means that the shortest distance from any point on the bottom interior surface to the fluid escape opening is downwardly inclined. The downwardly-tapered bottom panel reduces water turbulence as water flows from the tank to the fluid escape opening during a flush cycle.

In order to minimize turbulence attributable to the shape of the tank caused by water flow as the tank empties, the new tank may have a cylindrical wall continuous with the downwardly tapering bottom portion. The fluid escape opening is centrally positioned in the bottom portion of the tank. In order to further reduce turbulence created by water flow within the tank during a flush cycle, a flush valve plunger has a frusto-conical stopper portion and a cylindrical upper portion with no abrupt transitions. The frusto-conical shape of the stopper portion coupled with a lack of abrupt transitions facilitates water flow through the fluid escape opening, thereby increasing the velocity and, hence, the energy of the water as it escapes the tank and enters the toilet bowl. The flush valve plunger incorporates an overflow/bowl refill tube, which passes through the center of the plunger.

The new toilet tank may also include at least three vertical partitions intersecting a common axis which not only provide a cage in which the flush valve plunger can slide up and down, but also prevent the water from swirling and forming an energy robbing vortex Alternatively, the fluid escape opening incorporates a support structure which is attached to a central guide over which the valve plunger slides. The tank may incorporate vortex spoiling panels to increase fluid velocity through the fluid escape opening.

As an optional feature to further increase the energy of water released into the toilet bowl, the tank assembly may also incorporate a free-fall tube below the fluid escape opening.

Please note that although a tank lid is shown in cross section in FIGS. 2, 4, 6, 8, 10 and 12, the lids have been removed from FIGS. 1, 3, 5, 7, 9 and 11 so that the details within the tanks are visible.

DETAILED DISCLOSURE OF THE INVENTION

The focus of the present invention is to increase the kinetic energy of water as it flows from the water supply tank into the toilet bowl. The invention includes a toilet tank assembly having a water receptacle portion with a bottom interior surface that tapers downwardly from the outer edges thereof to an fluid escape opening. This means that the shortest distance from any point on the bottom interior surface to the fluid escape opening is downwardly inclined. The downwardly-tapered bottom panel helps to maintain water pressure over the fluid escape opening as the water level drops during a flush cycle. It also reduces water turbulence as water flows from the tank into the fluid escape opening.

Figure 1:
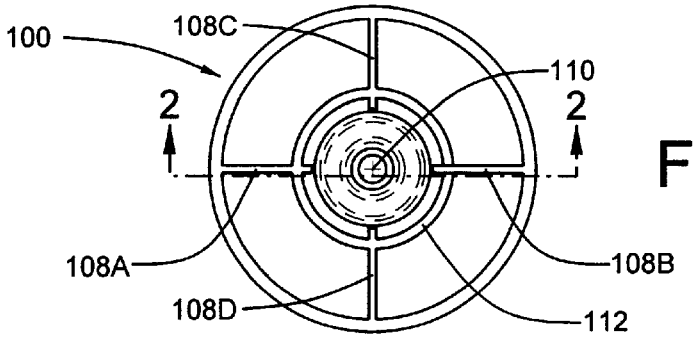
FIG. 1 is a top plan view of a first embodiment of the new toilet tank assembly.
Figure 2:
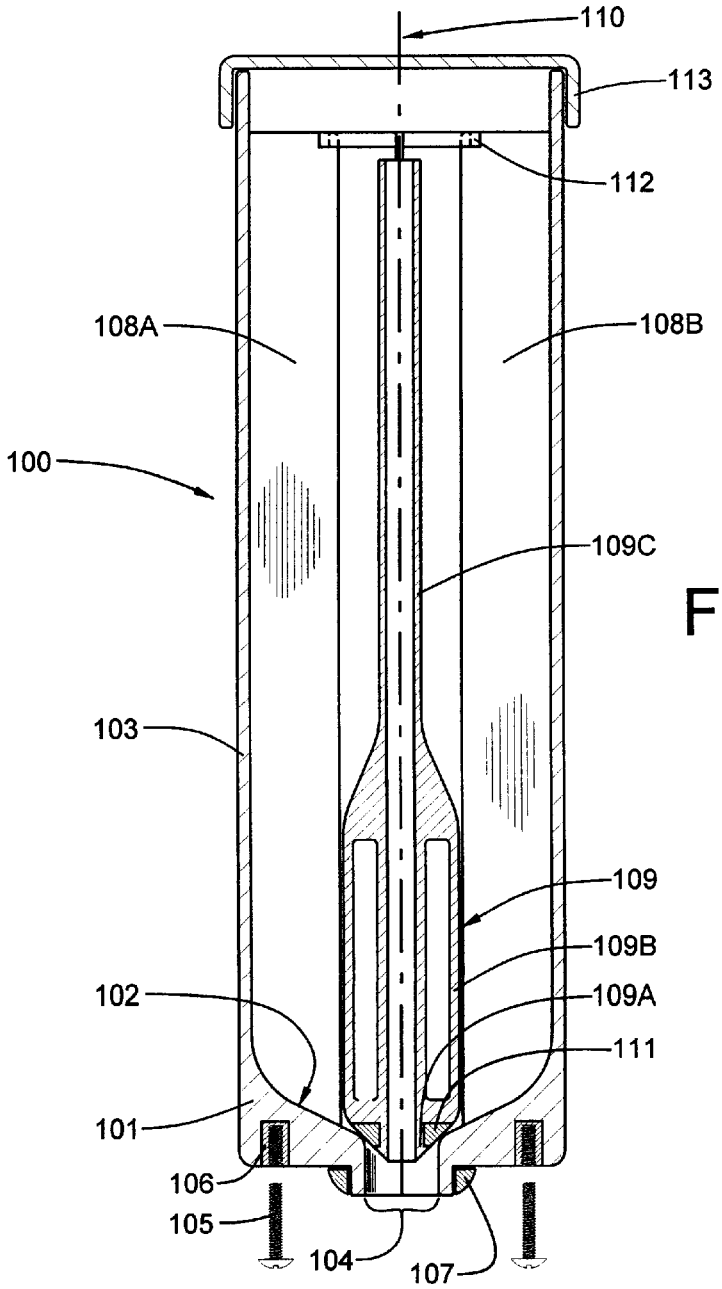
FIG. 2 is a cross-sectional view of the new toilet tank assembly of FIG. 1, taken through section line 2—2 of FIG. 1.

Referring now to FIGS. 1 and 2, a first embodiment of the new toilet tank assembly 100 has a cylindrical tank unit 101 having a bottom interior surface 102 that tapers downwardly from the cylindrical wall 103 to a centrally located fluid escape opening 104. The tank may be secured to a toilet bowl (not shown) with attachment screws 105, which mate nuts 106 that are cast or molded into the tank assembly. A circular gasket 107 seals the gap between the tank assembly 100 and the toilet bowl. The tank assembly 100 also includes a flush valve plunger 109. This particular embodiment of the new tank assembly is equipped with four vertical panels 108A–108D, which form a cage in which the flush valve plunger 109 slides up and down about its vertical axis of symmetry 110. The four vertical panels 108A–108D also minimize vortex formation as the water flows through the fluid escape opening 104. The plunger 109 has a frusto-conical stopper portion 109A continuous with a hollow cylindrical portion 109B. The plunger 109 also has a vertical overflow tube portion 109C, which extends upwardly from the cylindrical portion 109B. The stopper portion 109A is equipped with a resilient circular seal 111, which may be stretched to install it over the end of the stopper portion 109A. Pressure-sensing fill valves are well known in the plumbing industry, and may be readily adapted to work with the present invention. For example, the sensor can be threadably installed in the bottom of the receptacle portion 101. A bowl refill tube (now shown) may be routed either within or without the receptacle portion of the tank assembly and directed into the opening at the top of the overflow tube portion 109C. A circular stabilizing ring 112 interconnects all four vertical panels 108A–108D, thereby rigidifying the plunger cage formed thereby. For a preferred embodiment of the invention, each of the vertical panels 108A–108D is aligned with planes that intersect the vertical axis 110. A cover 113 fits over the upper edge of the cylindrical wall 103. As there is nothing novel in regard to the covers shown in FIGS. 2, 4, 6, 8 10 and 12, no further reference will be made to them.

Figure 3:
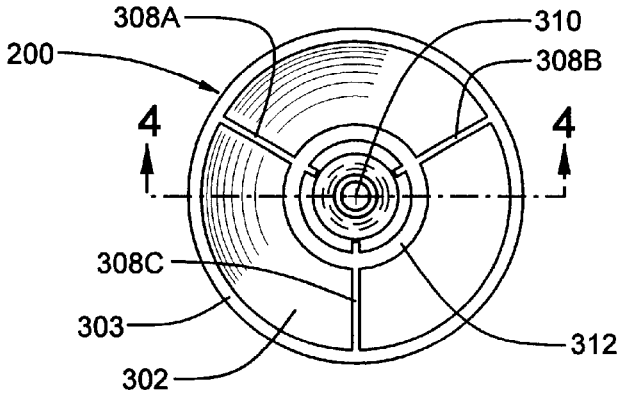
FIG. 3 is a top plan view of a second embodiment the new toilet tank assembly.
Figure 4:
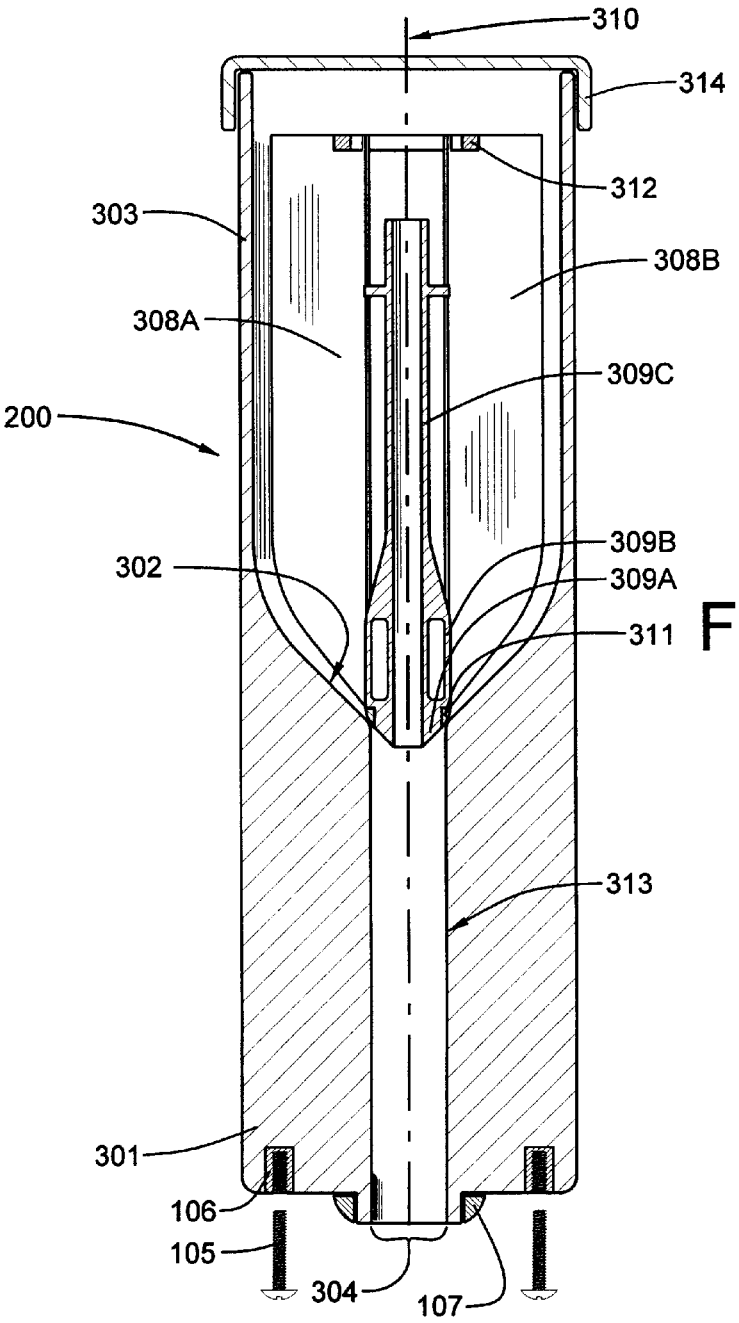
FIG. 4 is a cross-sectional view of the new toilet tank assembly of FIG. 3, taken through section line 4—4 of FIG. 3.

The second embodiment toilet tank assembly 300 depicted in FIGS. 3 and 4 is similar to that of FIGS. 1 and 2. The assembly 300 includes a tank unit 301 and a plunger 309. The tank unit 301 has a cylindrical wall portion 303 and a downwardly tapering floor portion 302. The first major difference is that it employs only three vertical panels 308A–308C to form the cage in which the plunger assembly 309 slides. The plunger unit 309 includes a lower frusto-conical lower portion 309A that is fitted with a circular seal 311, a hollow cylindrical portion 309B which acts as a float, and a tubular overflow portion 309C. As in the embodiment of FIGS. 1 and 2, a circular stabilizing ring 312 interconnects the three vertical panels 308A–308C. The second major difference is that a free fall tube 313 has been incorporated into the tank unit 301. The lower opening 304 of the free fall tube 313 empties into an attached toilet bowl (not shown). A tank lid 314 is also shown in FIG. 4. Compared to the tank assembly of FIGS. 1 and 2, the assembly of FIGS. 3 and 4 provides an additional benefit that nearly all the water contained within the receptacle portion 301 escapes during a flush cycle. Thus, water flow into the bowl may be increased only marginally by holding down the flush handle (not shown).

Figure 5:
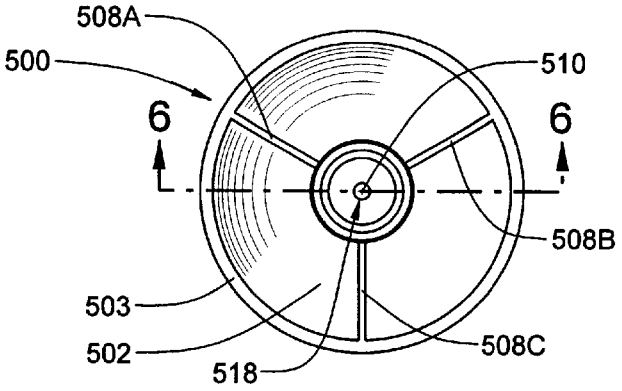
FIG. 5 is a top plan view of a third embodiment of a third embodiment of the new toilet tank assembly.
Figure 6:
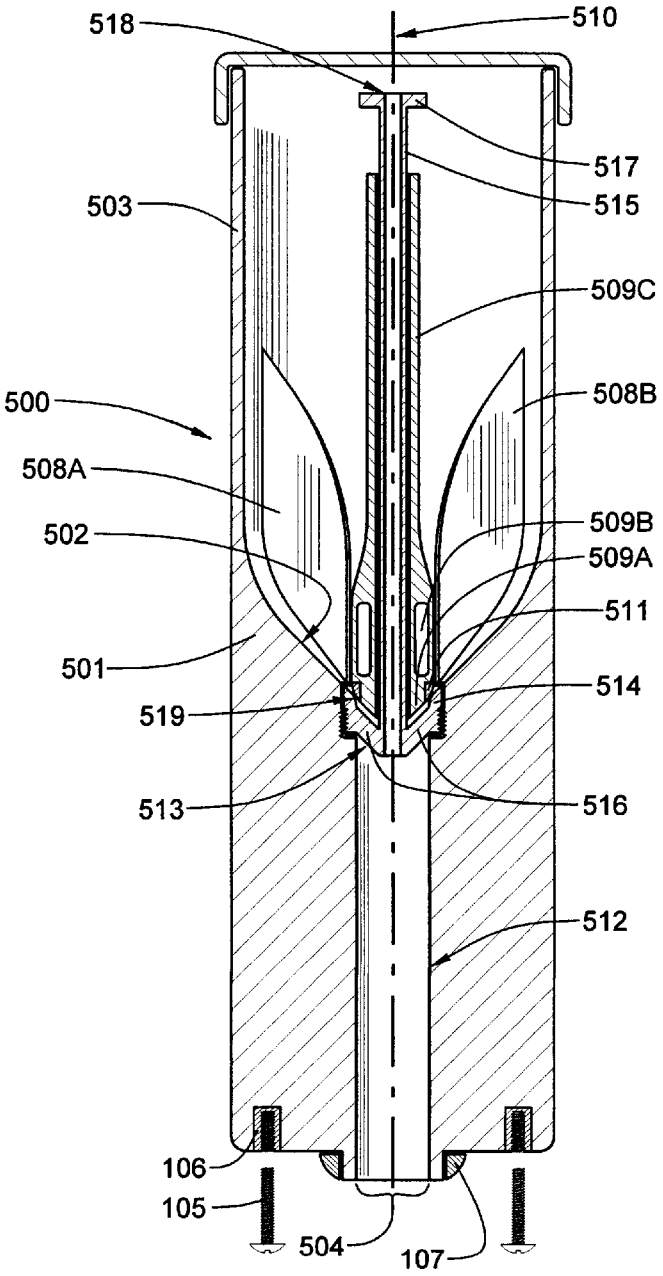
FIG. 6 is a cross-sectional view of the new toilet tank assembly of FIG. 5, taken through section line 6—6 of FIG. 5.

The third embodiment of the invention shown in FIGS. 5 and 6 is similar to the second embodiment of FIGS. 3 and 4. This embodiment also features a free fall tube 512. The main difference between this embodiment and the second embodiment of FIGS. 3 and 4 is that vertical panels 508A–508C do not form a cage in which the flush valve plunger 509 slides and exist simply to prevent vortices within the tank unit 301 as water flows into the free-fall tube 512 and then out fluid escape opening 504. Rather than relying on a cage, the upper end of the free fall tube 512 is threaded to receive an flush valve assembly 513. The flush valve assembly 513 is constructed similarly to the flush valve assembly of U.S. Pat. No. 4,504,763 (the '763 patent). Like the flush valve assembly of the '763 patent, the flush valve assembly 513 includes a circumferentially threaded valve body 514 and a vertically oriented guide 515 integral with the valve body 514. The guide 515 is attached to the valve body 514 by a support structure consisting of at least one vertically-oriented laminar spokes 516. The guide is shown as being a tublar member. It may be perforated at the upper end so that the tubular portion 509C of the plunger 509 determines the overflow level. Alteratively, like the guide of the '763 patent, it may have an X-shaped cross-shaped cross section. For the present embodiment, four spokes 516 are employed to secure the guide 515 to the valve body 514, two of which are seen in this view. The spokes 516 are sufficiently thin that they do not significantly restrict fluid flow through the valve body 514. The plunger 509 is slidably mounted on the guide 515. A perforated cap 517 secured to the top of the guide 515 both limits upward travel of the plunger 509 and provides an anchor through aperture 518 for a bowl fill tube (not shown). The flush valve assembly 513 differs from that of the '763 patent in that each laminar support spoke 516 is angled downwardly from the valve body 514 to the guide so as to provide clearance for the frusto-conical stopper portion 509A of plunger 509. The hollow cylindrical portion of plunger 509 functions as a float, and the height of tubular portion 509C determines the overflow level. An additional difference is that the valve body 514 incorporates a valve seat 519 and the plunger 509 incorporates the seal 511. For the device of the '763 patent, the valve body incorporates the seal and a dome-shaped float incorporates the valve seat. It is believed that the flush valve assembly 513 represents an improvement over the flush valve assembly of the '763 patent in that fluid turbulence caused by water passing through the valve body during a flush cycle is greatly reduced by the smoother transitions of the present valve assembly 513.

Figure 7:
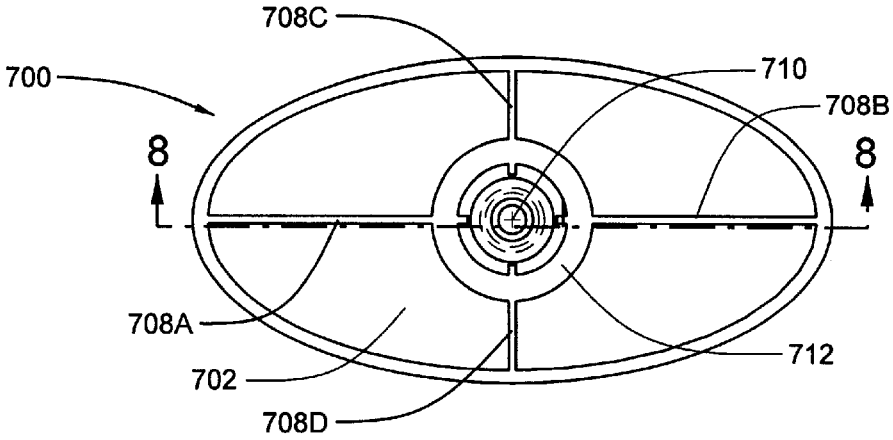
FIG. 7 is a top plan view of a fourth embodiment of the new toilet tank assembly.
Figure 8:
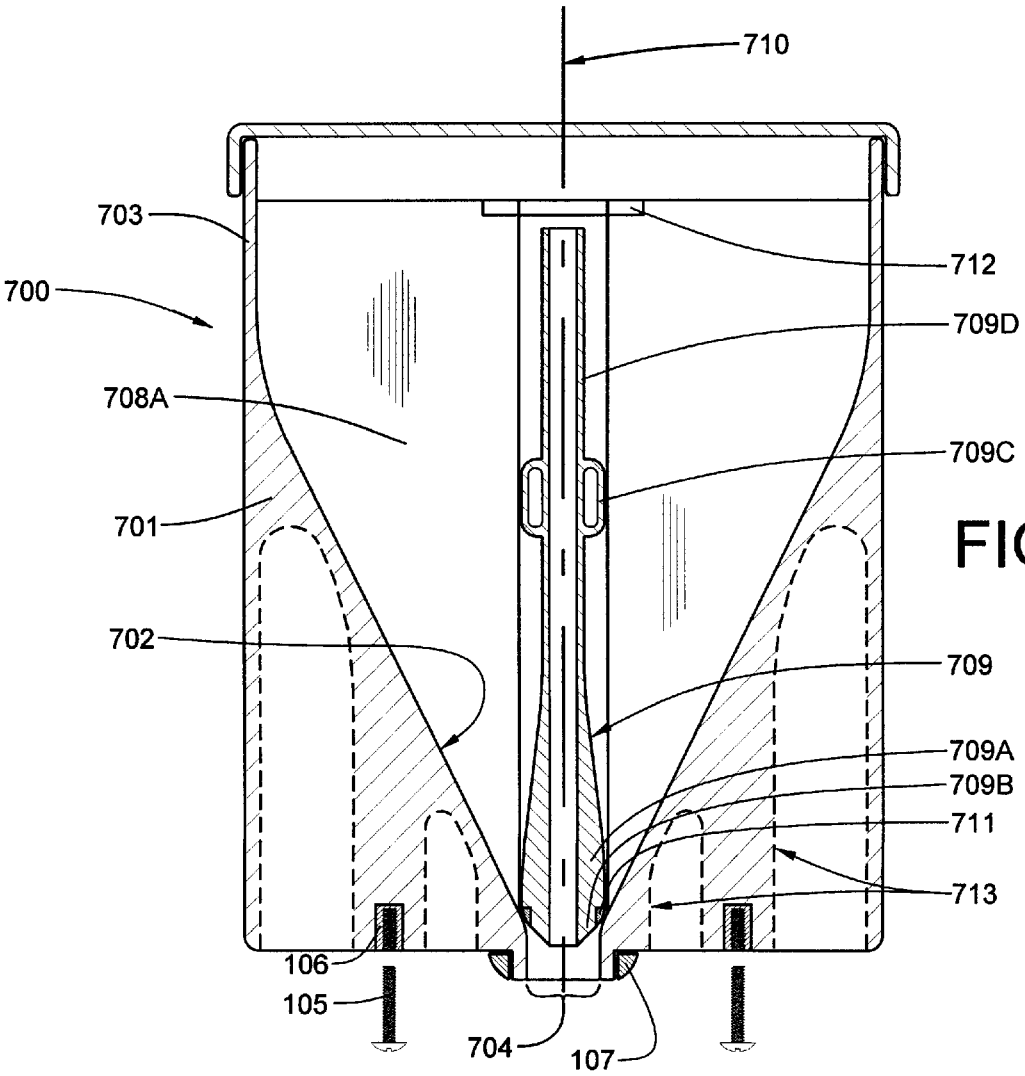
FIG. 8 is a cross-sectional view of the new toilet tank assembly of FIG. 7, taken through section line 8—8 of FIG. 7.

Referring now to FIGS. 7 and 8, the fourth embodiment of the invention features an ellipsoid-shaped tank assembly 700. The tank assembly includes a tank unit 701 and a plunger 709. The tank unit 701 includes a lower surface 702 that tapers downwardly from a vertical wall portion 703 to a centrally located fluid escape opening 704. In function, this embodiment functions much like that of the first embodiment shown in FIGS. 1 and 2. The flush valve plunger 709 slides about its vertical axis 710 within a cage formed by four vertical panels 108A–708D, which are interconnected by a support ring 712. The plunger 709 incorporates a lower portion 709A having a frusto-conical end portion 709B fitted with a circular seal 711. A float portion 709C is positioned about midway up a tubular portion 709D thereof. The location of the float 709C causes the plunger 709 to close the fluid escape opening 704 before the tank has completely emptied during a flush cycle. Its location on the overflow tube portion 709D will thus determine the amount of water released during a flush cycle. The plunger 709 also has a frusto-conical portion 709A that is fitted with a circular seal 711. The tank assembly may be injection molded from polymeric compounds, or may be manufactured from conventional glazed ceramic material. Cavities 713 have been formed in the lower portion of the tank unit 701 in order to minimize the material from which the tank unit 701 is formed, thereby reducing weight and manufacturing costs.

Figure 9:
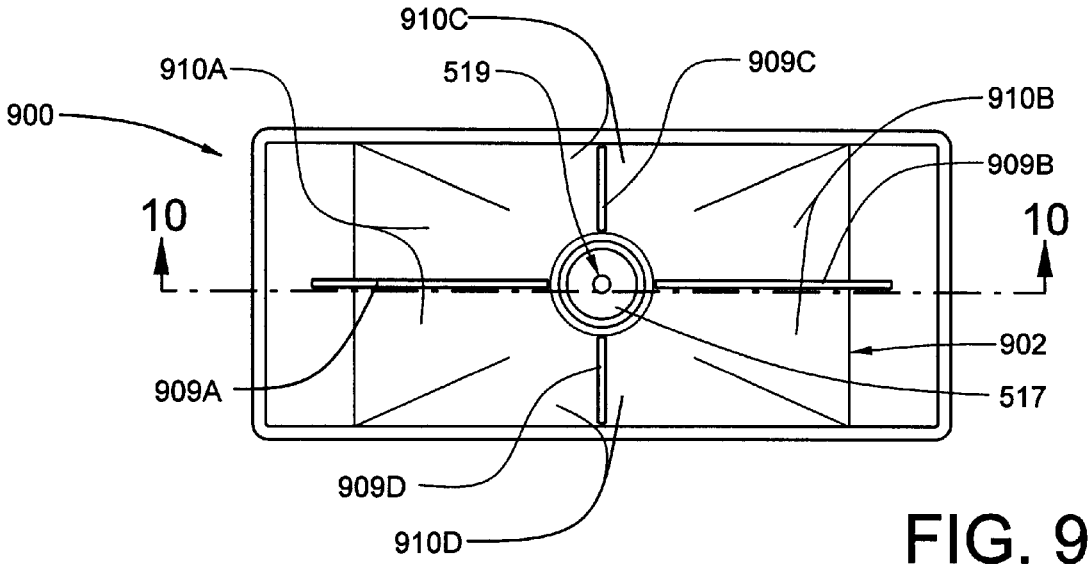
FIG. 9 is a top plan view of a fifth embodiment the new toilet tank assembly.
Figure 10:
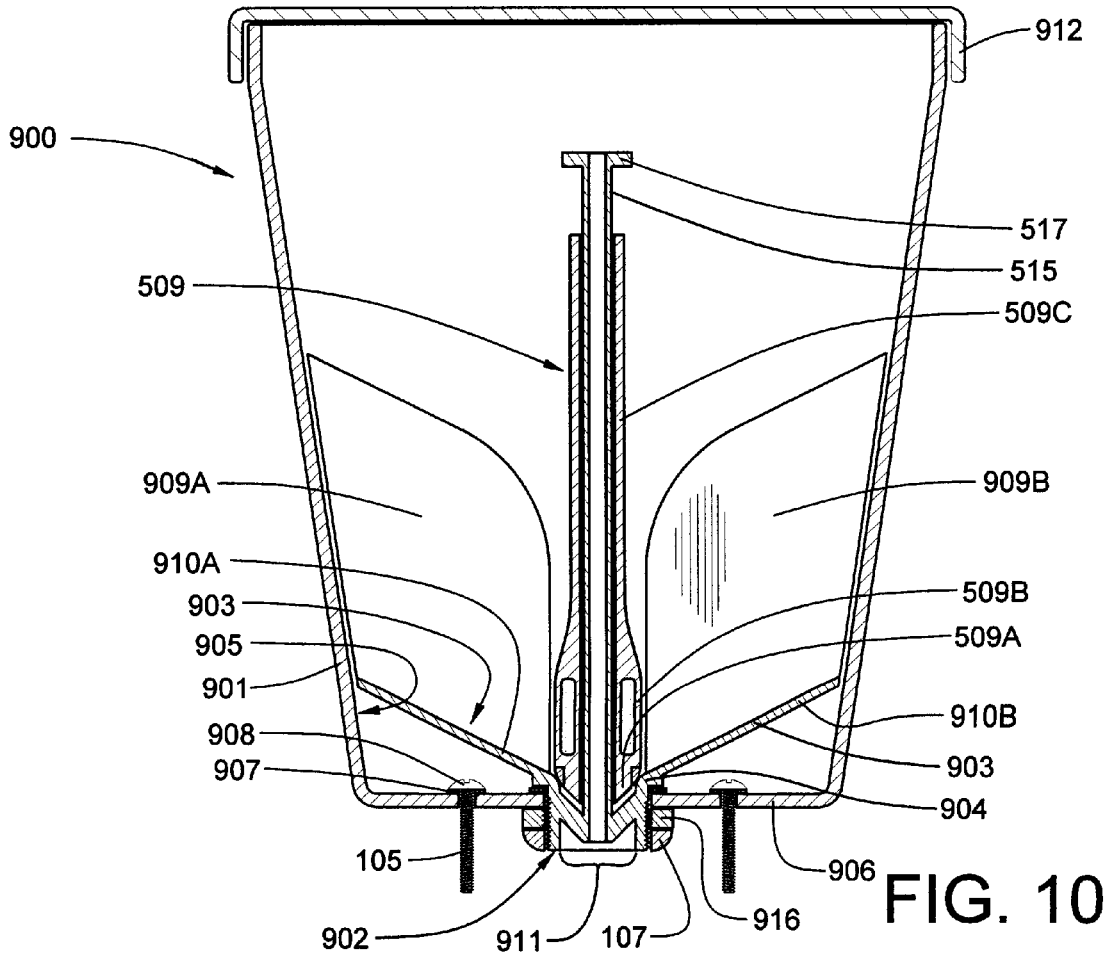
FIG. 10 is a cross-sectional view of the new toilet tank assembly of FIG. 9, taken through section line 10—10 of FIG. 9.

Referring now to FIGS. 9 and 10, the fifth embodiment 900 of the invention employs a more conventional looking tank unit 901. A flush valve assembly 902 similar to that of the third embodiment of the invention of FIGS. 5 and 6 incorporates a hopper-like appendage 903 on the threaded valve body 904. The appendage 903 extends outwardly from the valve body 904 to contact or almost contact the inner circumferential surface 905 of the tank unit 901. The valve body 904 is attached to the bottom wall 906 of the tank unit 901 much like the valve seat of a conventional toilet tank is attached thereto. The hopper-like appendage 903 includes two pairs of mutually interconnected, opposing, downwardly inclined, fluid directing surfaces 910A/910B and 910C/910D, which terminate at a fluid escape opening 911 positioned at a lower-most level of said tank. The appendage 903 is constructed such that as a level of fluid touching these surfaces within the tank drops any amount in response to the escape of fluid through said opening, the area of an upper surface of the remaining escapable fluid decreases. The funnel-like appendage 903 provides a surface which tapers downwardly from the walls of the tank unit 901 to the fluid escape opening 904. There is no need to seal the space 906 between the appendage 903 and the bottom wall 906 of the tank unit 901. As long as the appendage 903 is not hermetically sealed at its outer edges to the circumferential wall 905 of the tank unit 901, a conventional pressure-sensitive filler valve (not shown) may be mounted through the bottom wall 906. The attachment screws 105 are fitted with sealing washers 907 beneath their heads 908, as is conventional in the art. A tank lid 912 is also shown in FIG. 10. Vertically-oriented fins 909A–909D restrict the formation of vortices within the tank unit 901.

Figure 11:
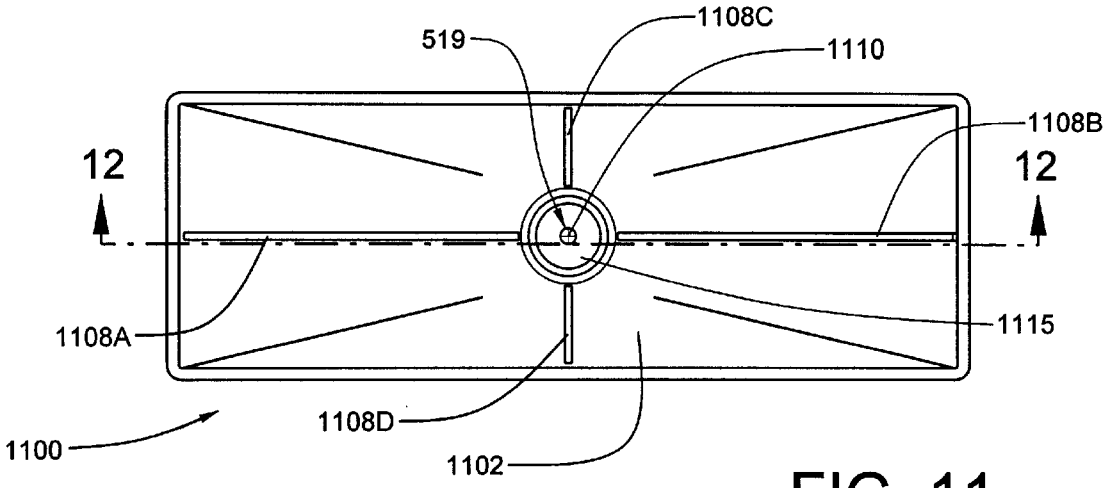
FIG. 11 is a top plan view of a sixth embodiment of the new toilet tank assembly.
Figure 12:
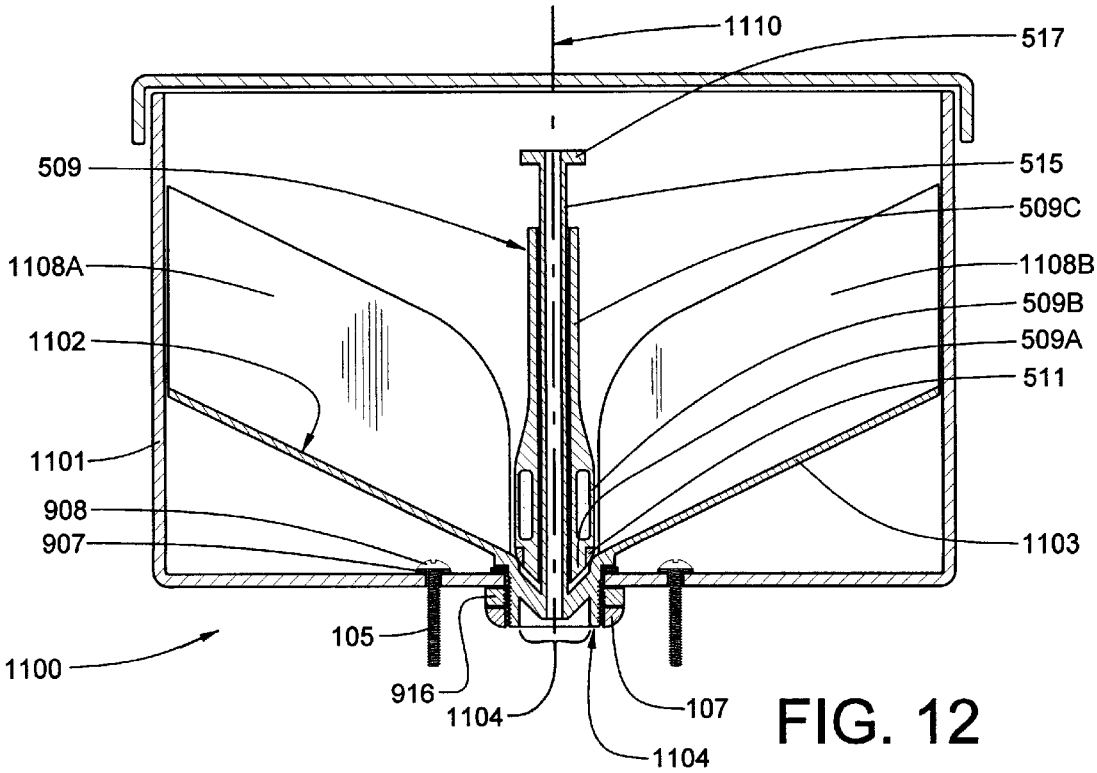
FIG. 12 is a cross-sectional view of the new toilet tank assembly of FIG. 11, taken through section line 12—12 of FIG. 11.

Referring now to FIGS. 11 and 12, the sixth embodiment of the invention is incorporated into a completely conventional looking toilet tank 1101. However, with the incorporation of a valve body 1104 and attached appendage 1103, which are similar to the valve body 904 and appendage 903 of FIGS. 9 and 10, the conventional toilet tank may be modified to incorporate the invention. Functional elements of the toilet tank assembly 1100, which are similar, if not identical to those of FIGS. 5, 6, 9 and 10, are numbered the same. The vertically-oriented panels 1108A–1108D correspond to 908A–908D of FIG. 9 and 10. The bottom surface 1102 tapers from a uniform level on all four walls 1101A–1101D to a more funnel-like surface near the fluid escape opening1104. The plunger 509 is vertically movable about vertical axis of symmetry 1110.

Although only several embodiments of the present invention have been disclosed herein, it will be obvious to those having ordinary skill in the art that changes and modifications may be made thereto without departing from the scope and spirit of the invention as hereinafter claimed. Clearly, any of the tank assembly embodiments described herein may be adapted to receive the flush valve assembly 505 of FIGS. 5 and 6. Additionally, although unpressurized toilet supply tanks benefit to a far greater degree from a reduction in turbulence brought about by the tank having a tapered bottom surface, the principle can also be applied to toilet supply tanks which use line water pressure to pressurize the tank prior to each flush cycle.

What is claimed is:

1. A toilet tank comprising:

a liquid retaining receptacle having a fluid escape opening positioned at the bottom thereof, said receptacle having a lower surface which radially tapers upwardly from said fluid escape opening;

said fluid escape opening is radially symmetrical about a vertical axis; and at least three vortex-spoiling panels affixed to said lower surface and form a cage for a flush valve plunger, each of said panels being aligned with a plane, all planes intersecting the vertical axis.

2. The toilet tank of claim 1, wherein said fluid escape opening incorporates a valve seat, and said flush valve plunger comprises a frusto-conical lower portion which circumferentially mates with said valve seat.

3. The toilet tank of claim 1, which further comprises:

a flush valve assembly comprising a valve body having an exit orifice and installed within said fluid escape opening;

a vertically-oriented guide axially affixed to said valve body via at least one spoke; and a plunger slidably mounted on said guide for reversibly sealing said exit orifice.

4. A toilet tank comprising downwardly inclined, fluid directing surfaces which taper inwardly toward a fluid escape opening positioned at a lower-most level of said tank, such that as a level of fluid touching these surfaces within the tank drops any amount in response to the escape of fluid through said opening, the area of an upper surface of the remaining escapable fluid decreases and multiple vortex-spoiling panels affixed to said surfaces and form a cage for a flush valve plunger.

5. The toilet tank of claim 4, wherein said fluid directing surfaces taper linearly toward the fluid escape opening.

6. The toilet tank of claim 4, which further comprises a vertically-oriented free-fall tube continuous with said fluid escape opening which extends vertically below said fluid escape opening, said free-fall tube extending to a base portion connectable to a toilet bowl.

* * * * *